US006994632B2

(12) United States Patent
Morin

(10) Patent No.: US 6,994,632 B2
(45) Date of Patent: Feb. 7, 2006

(54) GOLF TRAINING INSTALLATION

(76) Inventor: Laurent Morin, 18 Rue du Soleil, 13007 Marseilles (FR)

( * ) Notice: Subject to any disclaimer, the term of this patent is extended or adjusted under 35 U.S.C. 154(b) by 0 days.

(21) Appl. No.: 10/204,162

(22) PCT Filed: Feb. 9, 2001

(86) PCT No.: PCT/FR01/00384

§ 371 (c)(1),
(2), (4) Date: Aug. 19, 2002

(87) PCT Pub. No.: WO01/60466

PCT Pub. Date: Aug. 23, 2001

(65) Prior Publication Data

US 2003/0060300 A1 Mar. 27, 2003

(30) Foreign Application Priority Data

Feb. 17, 2000 (FR) ..... 00 01934

(51) Int. Cl.
*A63B 69/36* (2006.01)

(52) U.S. Cl. ..... 473/195; 172/173; 172/197

(58) Field of Classification Search ..... 473/195–197, 473/172, 173

See application file for complete search history.

(56) References Cited

U.S. PATENT DOCUMENTS

| | | | | | |
|---|---|---|---|---|---|
| 1,540,670 | A | * | 6/1925 | Vidmer | 473/190 |
| 1,677,442 | A | * | 7/1928 | Hall | 473/190 |
| 1,719,240 | A | * | 7/1929 | Scanlan | 473/190 |
| 2,248,053 | A | | 7/1941 | Bales | 273/35 |
| 2,455,185 | A | * | 11/1948 | May | 473/195 |
| 2,988,363 | A | * | 6/1961 | Hall | 473/190 |
| 4,655,460 | A | | 4/1987 | Hambright | 273/185 |
| 5,286,029 | A | | 2/1994 | Smit | 273/181 |
| 5,609,528 | A | * | 3/1997 | Kehoe | 473/157 |

* cited by examiner

*Primary Examiner*—Mark S. Graham
(74) *Attorney, Agent, or Firm*—Cohen, Pontani, Lieberman & Pavane

(57) ABSTRACT

An installation that is useful in learning to play golf, in training, or in evaluating the level of a golf player, the installation being characterized in that it comprises: a zone (1) marked on the ground and preferably comprising a mat, for monitoring the positioning of the player, and equipment representing an obstacle (3) over which the player must cause the ball to pass, the equipment being at a height of at least 2 m, and preferably of at least 5 m, and being at a distance of 5 m to 200 m, and preferably of at least 10 m.

41 Claims, 3 Drawing Sheets

GOLF TRAINING INSTALLATION

CROSS-REFERENCE TO RELATED APPLICATIONS.

This application claims priority from PCT application, Ser. No. PCT/FR01/00384, filed Feb. 9, 2001, which designated the United States, and claims priority from French patent application Ser. No. 00/01934, filed Feb. 17, 2000.

BACKGROUND OF THE INVENTION

1. Field of the Invention

The present invention relates to an installation that is useful in learning to play golf, in training, or in evaluating the level of a golf player.

The installation of the present invention is useful for implementing a novel method of teaching golf or a novel method of training for golf, or a novel method of evaluating the level of a golf player.

2. Description of Related Art

In traditional methods of teaching golf, the teaching process is based on analyzing the action of the player and then correcting it by directly correcting the player's action. Some methods make use of training tools which are usually placed on the player, for example under the arms, between the legs, or at the waist and which serve to monitor some particular portion of the action.

Those prior art methods and installations present the following drawbacks or omissions:

- the player is led to intellectualize the advice and corrections received while carrying out an action, which can lead to a player paying too much attention to a portion only of the action to the detriment of other portions;
- they require a great deal of time and practice in order to correct a fault.

BRIEF SUMMARY OF THE INVENTION

The object of the present invention is to provide a method and an installation for teaching golf progressively and globally, using special equipment that is of increasing difficulty for each stage in learning how to play golf.

Another object of the present invention is to provide a method and an installation that enable experienced players to train and improve.

Another object of the present invention is to provide a method and an installation enabling the level of a golf player to be evaluated.

To do this, the present invention provides an installation that is useful for learning to play golf, for training, or for evaluating the level of a golf player, the installation comprising:

- a zone for positioning at least one player, preferably marked on the ground to monitor said positioning of the player, the zone preferably comprising at least one mat on which there is preferably marking for monitoring the positioning of the player, and in particular the positions of a player's feet; and
- equipment representing an obstacle over which the player is to drive a ball, the equipment being at a height of at least 2 meters (m) and preferably at least 3 m, and more preferably at least 5 m, and at a distance of 5 m to 200 m, and in particular not less than 10 m.

The player drives the ball with a club so as to cause it to pass over the obstacle whose height and position may vary depending on the competence of the player, as explained below when describing various different installations of the invention.

Advantageously, said equipment representing the obstacle is placed at a distance lying in the range 5 m to 100 m from said zone, preferably in the range 10 m to 80 m, and represents a height to be passed over of 3 m to 15 m, and preferably of at least 5 m, and in particular of 5 m to 7 m.

In a preferred embodiment, said obstacle comprises at least one front panel held vertically by means of at least one post, with the panel(s) defining at least two zones of different colors placed side by side in the transverse direction at said post(s).

In particular, said obstacle comprises at least one front panel constituted by a tensioned sheet that is disposed vertically. When a plurality of such sheets are used, they are placed side by side in said transverse direction at the post. The sheet(s) can be tensioned in a metal frame suitable for being moved vertically along said posts.

The zone marked on the ground can serve to mark the positions of a plurality of players standing side by side in front of the obstacle, in particular in a direction that is parallel to said panel. Under such circumstances, the distance of the obstacle represents the distance between the straight line defined by the positions of said players within said zone, and said obstacle, and in particular said front panel.

This installation makes it possible to acquire and to improve a player's action in global and progressive manner, in particular the fundamental twisting and swinging action on which a drive is based, known as "swing", as a function of the respective positions of the player and of the equipment, with the player concentrating solely on the objective to be achieved which is to drive a ball over the obstacle, and not on how that objective is to be achieved, i.e. without the player concentrating on positioning proper or on the movements to be performed in order to drive properly.

In the present invention, by means of the positioning of the various elements relative to the players, the equipment encourages movements of a certain type by the visual attraction it exercises on the player.

In traditional teaching of golf, the player's intellect is called on to act directly on the movements to be carried out. Using the equipment and the method of the invention, the player's intellect concentrates solely on understanding the objective to be achieved, i.e. the obstacle over which the ball is to be driven. Specifically, the player has to drive the ball over obstacles that are constituted by various panels, and more particularly over specific colored zones of said panels. Changing obstacle consists in changing the colored zone over which a ball is to be driven from a given playing position, which implies automatic, indirect, and involuntary modification and adaptation of player positioning, in particular concerning alignment of the body relative to the target. The player is no longer obsessed with trying to drive the ball, but concentrates on the obstacle over which the ball is to be driven. It is this obstacle which induces the player's action, particularly when said obstacle is close in distance and height relative to the player. By adapting the characteristics of the obstacle (its height and distance), the player's action can be improved or refined progressively.

In a first variant embodiment, the obstacle comprises at least one front panel, the top edge of said panel being situated at 3 m to 10 m above the ground, preferably at 5 m to 7 m, and said panel(s) defining at least two zones, in particular symmetrical zones about the vertical mid-axis of said panel or said set of panels, the panel(s) being situated at a distance of 5 m to 25 m from said zone, and the ratio of said height to said distance being not less than ⅓, and preferably ½.

The panel or the set of panels can present a length of 3 m to 20 m, and preferably of 10 m to 15 m.

This installation is referred to as a "Castle" and is the basic installation of the present invention on which to learn golf. It serves specifically to enable beginners, and in particular players having a handicap in the range 24 to 36, to act relative to a target. The closeness of the target enables players to carry out an action that is generally correct merely by forcing players to reach the target, which is to drive the ball over the obstacle. This action necessarily causes the player to position the body in such a manner as to prepare the action on the back leg, as is appropriate. The player's desire to drive the ball over the panel automatically causes the player to move the lower part of the body initially, and subsequently to raise the arms above the body and the obstacle, thereby developing the proper driving action.

In an initial stage, the player need only cause the balls to go over the panel, thus learning to coordinate the driving action and acquiring coordinated reflexes in the driving action.

In a second stage, the player is required to drive balls alternately over each of the zones of different colors, thus enabling a player to become aware of the need to move the body, in particular the lower part of the body so as to accommodate changes in the direction to the obstacle.

This second stage enables a player standing on the center of the mat to start associating a particular direction with a particular position of the body by turning the body alternately to right and to left.

To do this, it is preferable for the top edge of each of said front panels to define a crenellation comprising a notch in each of said colored zones, and two notches are preferably disposed symmetrically about a middle vertical axis in each of said colored zones.

In this embodiment, a player can in a third stage cause the ball to pass alternately over each of the notches, thereby refining the player's action in association with better control over alignment in a particular direction.

Said front panel preferably has a height of 2 m to 5 m and is movable vertically relative to the ground along said posts.

In a second variant embodiment, the installation comprises:

a zone marked on the ground preferably comprising a mat with marking enabling the position of the player's feet to be monitored, preferably comprising at least two orthogonal lines which preferably coincide in the center of said zone, and preferably in the center of said mat;

said obstacle comprises at least one front panel disposed between two posts;

a first post is in alignment with a first one of said orthogonal lines;

the other post is aligned with said first post in a direction parallel to the other one of said orthogonal lines of said marking; and two rectangular side panels, preferably in the form of nets or wire netting are disposed vertically on either side of said zone on the ground, close thereto, and extending in a direction parallel to said first orthogonal line.

For a right-handed player said second post is situated to the right of said first post and vice versa for left-handed player.

More particularly, in this second variant, an installation which is adapted both to left-handed and right-handed players, comprises:

a said zone on the ground or a said mat; and three posts having two front panels held between them, the panels being of different colors and each being disposed between the central post and a respective outer post.

More particularly, in this second variant, said first or central post is situated at a distance of 15 m to 45 m from the center of the mat, and preferably at a distance of 15 m to 25 m, and each of said front panels is preferably 2 m to 5 m long, with the top horizontal edge of the front panel(s) being situated at a height of 3 m to 10 m above the ground. In this second variant, the front panels can extend 2 m to 5 m in the vertical direction.

The installation constituting this second variant serves to work on and improve the driving action by emphasizing body alignment relative to the target, i.e. in particular the positioning of the feet relative to the direction of the trajectory that the ball is to follow, which is associated with an environment represented by the side nets or wire netting.

This installation is referred to as a "Corridor" and the corresponding exercise improves integration of the driving action by emphasizing body positioning and the trajectory followed by the ball.

When in the correct position, the ends of a player's feet should define a straight line that is parallel to the trajectory. While training with an installation that only has marking on the mat for indicating the correct position of the feet, it has been found that once the mat or the marking is removed the player always departs from proper positioning. However, when using the equipment of the installation of the invention, the player automatically associates success with positioning relative to the environment and this visual perception persists even when said equipment is no longer there. When the equipment is removed, i.e. when the netting is removed, the visual perception thereof persists, thus enabling the player to continue taking up a proper position relative to this environment which has become virtual.

The height and the nearness of the front panels which are at a distance lying in the range 15 m to 45 m, in combination with the corridor effect, enables overall driving action to be developed in association with an ideal trajectory.

The player thus acquires reflexes of coordinating driving action so as to reach the desired location, where following a desired trajectory requires the action to be well coordinated.

Exercising with this installation avoids any compensation phenomenon in the way the action is carried out: the position of the club and the position of the feet are channeled by the marking on the mat and by the way the environment is embodied, so it is only proper coordination of the action that enables the proper trajectory to be achieved.

The role of the first two installations is thus to learn and improve an action globally. Pictures taken after using these installations for at least one hour reveal considerable mechanical changes in a player's action.

In a third variant of the installation of the present invention:

two front panels of different colors are placed on either side of a vertical post, the panels preferably being suspended respectively from at least one horizontal bar; and said vertical post is placed at a distance of 15 m to 45 m, and preferably at a distance of 20 m to 25 m from said zone, which zone has no marking for monitoring the position of a player's feet.

Each of said front panels is 2 m to 5 m long and 2 m to 5 m high, and the top edges of said panels, preferably where said horizontal bar(s) is/are placed, are at a height of 3 m to 10 m above the ground, and preferably of at least 5 m.

With the first two installations described above, the player acquires good coordination of action, but does not acquire routine positioning of the body relative to a target.

The third variant installation, referred to as a "Gallows" and the corresponding exercise are specific to acquiring good body positioning, in particular good alignment relative to the target. The player drives a ball alternately over the panel to the right and over the panel to the left of the central post. In this case the player is no longer assisted in positioning the feet and the ball on the mat. The player is obliged to change position and adjust alignment with changing target but without any assistance on each drive. At this stage, the difficulty experienced by a player is associated with poor positioning, in particular poor body alignment. The installation makes it possible to impart reliable routine body positioning prior to driving.

The purpose of this third installation is to acquire automatic correct positioning as a function of the direction of a drive, and thus relative to a target.

In a fourth variant of the installation of the invention:

three posts are placed in alignment, comprising two outer posts and a central post, the alignment is preferably substantially perpendicular to a straight line passing through the center of said zone on the ground or said mat and said central post;

two front panels of different colors are placed respectively between each of the outer posts and said central posts;

the central post being located at a distance of 50 m to 200 m, and preferably of at least 80 m from said mat;

each front panel having a length of 5 m to 20 m, and preferably of 5 m to 7 m; and the top edge of each front panel being situated at a height of 3 m to 10 m above the ground, and preferably at a height of at least 5 m.

More particularly, said front panels are suspended from at least one horizontal bar serving to connect each of the outer posts with the central post, and each panel itself has a height of 2 m to 5 m.

With this fourth installation, referred to as "Wide gates", a player practices driving a ball alternately over each of the panels of different colors.

This installation and the corresponding exercise serve to verify the effectiveness of player alignment and to stabilize a play routine by alternating directions, but with strokes that are longer.

In addition, this installation adds an additional notion relative to body alignment and trajectory: at this distance, the front panels are located in a zone where the ball is losing height. In the preceding installations, the player acquires an association between proper alignment and positioning of the body relative to a rising trajectory. However in this fourth installation the association is acquired relative to a falling trajectory. Subsequently, the player can acquire an association between body alignment and the positioning with a point of impact by using as a target a flag standing on a green and by alternating drives to the right and to the left of the flag.

Like the preceding installation, this fourth installation can be used in an exercise for improving trajectory by channeling the positioning of the feet on a mat that carries a marking of orthogonal lines, and where appropriate with the rectangular side panels, preferably in the form of nets or wire netting placed on either side of said mat to create a corridor sensation.

The invention also provides an installation further comprising a device which comprises:

a low first plate that is preferably less than 0.5 m high, situated in front of the position of a player when the player is positioned to drive a ball on the ground situated between the player and said first plate, the ball being at a distance from said first plate that is greater than half the width of the face of the club used by the player, and preferably less than 10 centimeters (cm), said first plate preferably being of length lying in the range 1 m to 2.50 m; and a tall second plate, that is preferably at least 1.5 m high, and more preferably 1.5 m to 2.5 m high, set back from the position of the player and on the side of the player that corresponds to the side towards which the player raises the club prior to driving the ball, the second plate being situated immediately behind the high starting position of the club before driving the ball;

such that the player must avoid touching either of said two plates when driving the ball and preparing to drive the ball.

The installations of the present invention makes it possible to master body alignment and coordination in the action known as a "swing". The inventor has observed that body alignment and swing coordination operate in an action-reaction system. It appears that deformation in body alignment or in swing coordination is always the same for a given category of level of play, while being different for different levels of play. Thus, if a player complains of a sudden deterioration in swing, it is possible to make the player aware of the direction in which deformation has taken place and then correct alignment and global swing action so as to acquire a more mature action and continue to make progress.

Installations of the present invention can thus be used in a method of training a golf player and in a method of teaching a player how to play golf in which use is made of installations of the present invention.

In the method of teaching a player how to play golf, it is preferable to use installations corresponding successively to said first, second, third, and fourth variants mentioned above.

More particularly, players are caused to carry out series of ten drives on each installation consecutively.

The various installations of the present invention have the special feature of being interactive: progress achieved by exercising on any one of them has effects on the results obtained when exercising on the other installations.

Still more particularly, a method of learning to play golf and of training a player comprises the following steps preferably in succession:

1) the player drives balls from said player location causing them to pass over said panels of said first installation;

2) the player drives balls from said player location, causing them to pass alternately over each of said different color zones of said first installation;

3) the player drives balls in said second installation, positioning the feet relative to said marking in the zone marked on the ground and causing the ball to pass over one of said front panels;

4) the player drives balls from said player location, causing balls to pass alternately over each of said different color front panels of said third installation; and 5) the player drives balls from said player location, causing the balls to pass alternately over each of said different color front panels of said fourth installation.

The present invention also provides a method of evaluating the level of a golf player, wherein the player performs a series of drives in an installation of the invention and is given a level as a function of success rate.

BRIEF DESCRIPTION OF THE SEVERAL VIEWS OF THE DRAWINGS

Other characteristics and advantages of the present invention appear in the light of the following detailed embodiment described with reference to FIGS. 1 to 4, in which.

DETAILED DESCRIPTION OF THE INVENTION

Figure 1A:
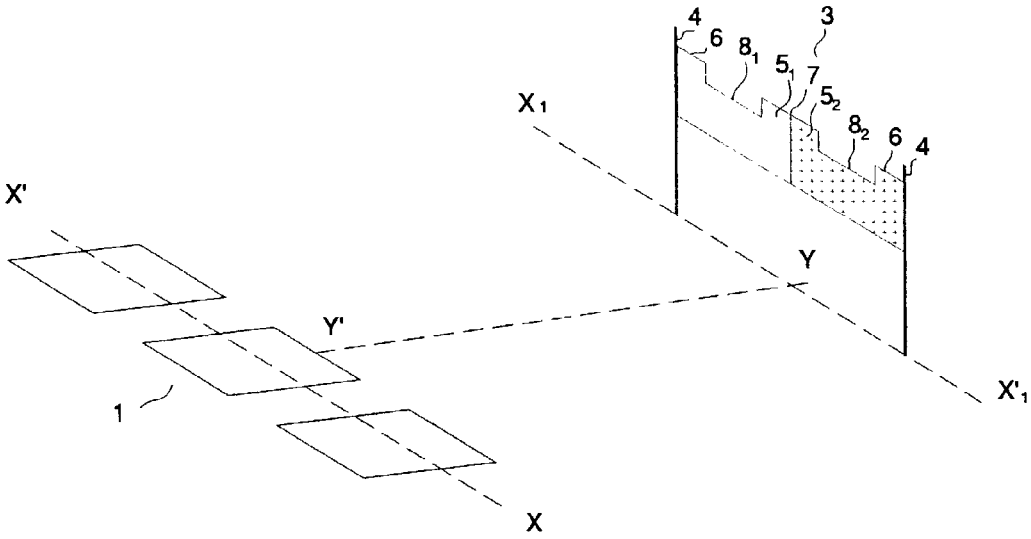
FIG. 1 shows the first variant installation referred to as the "Castle.
Figure 1B:
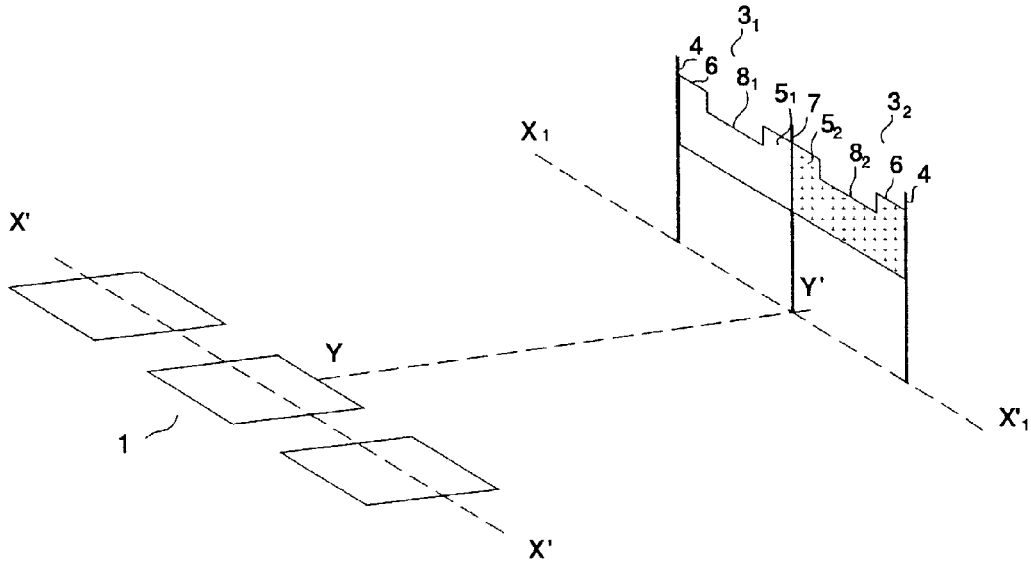

FIGS. 1A and 1B show two embodiments of the "Castle" installation comprising respectively two and three vertical posts. One or two 2-meter high front panels 3 are supported by two posts 4 in FIG. 1A or by three posts 4 in FIG. 1B. The top edge 6 of each front panel is placed at a height h of 5 m to 10 m above the ground for a distance d from said zone on the ground 1 where the player stands lying in the range 10 m to 20 m, so that the ratio h/d=½. In FIG. 1A, there is a single front panel tensioned between two posts 4. The vertical mid-axis 7 of the front panel defines two zones of different colors $\mathbf{5}_1$ and $\mathbf{5}_2$ on either side of the axis 7. The top edge 6 of the front panel has two notches $\mathbf{8}_1$ and $\mathbf{8}_2$ so to form crenellations.

In FIGS. 1A, 1B, 2, 3, and 4, three mats are shown. The distance between the zone and the obstacle represents the distance between the straight line XX' defined by the centers of said mats and/or the positions of said players, and the straight line defined by the alignment of the front panels $X_1X'_1$.

In FIG. 1A, the panel 3 has a length of 12 m; the installation is shown for three players, but a front panel of this length can enable six to eight players to play with the same equipment.

The front panel 3 is made of cloth that is tensioned, preferably in a metal frame (not shown) whose top edge includes a middle crenellation-forming notch. The metal frame is preferably arranged to slide in a groove on the side edges of the two posts. Handles at the feet of the posts can enable the frame to be raised and lowered.

Said front panels are advantageously constituted by cloth that needs to be sufficiently tensioned to be substantially flat with top and bottom edges that are substantially horizontal, but not excessively tensioned so as to ensure that a ball striking said cloth will not bounce back far enough to strike a player. For the same reasons, it is preferable for the posts to be covered in foam.

Advantageously, to ensure that the balls do not bounce on the cloth tensioned in the frame and do not come back to strike the players, it is advantageous to use the following protection:

- each post is surrounded by foam, and a protective net is placed around the foam-covered post; and
- a net is placed in front of the panel.

In the nets, the mesh size is smaller than the diameter of a golf ball, for example less than about 2 cm.

FIG. 1B shows two front panels $\mathbf{3}_1$ and $\mathbf{3}_2$ of different colors $\mathbf{5}_1$ and $\mathbf{5}_2$, each panel having the same width and each having a central notch $\mathbf{8}_1$ and $\mathbf{8}_2$ in its top edge 6. The two front panels are tensioned between three vertical posts. Each of the front panels defines one of said colored zones $\mathbf{5}_1$, $\mathbf{5}_2$.

In a variant, it is possible to use four front panels of different colors that are about 6 m long so as to make up a total length of about 24 m and enable up to ten players to play simultaneously.

The "Castle" installation can be used by driving with irons that make it progressively more difficult to lift the ball, i.e. with clubs that are more and more "closed", for example by beginning a series of shots using a No. 7 iron, then another series with a No. 6 iron, and a final series with a No. 5 iron.

The effectiveness of the "Castle" exercise depends on the distance between the player and the equipment, and on the height of the obstacle.

Figure 2:
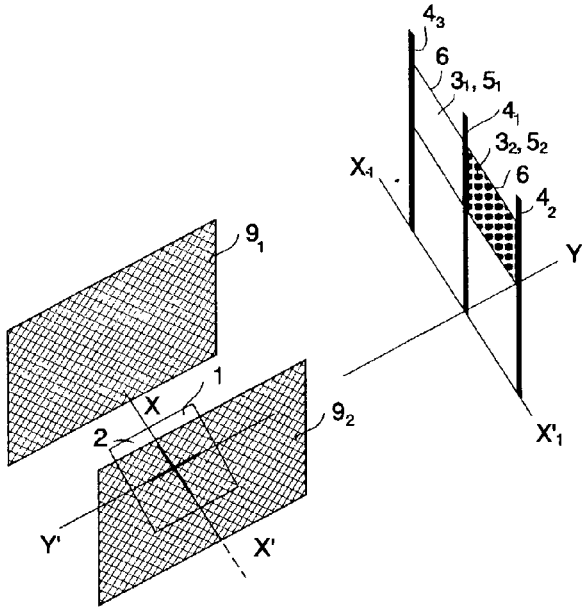
FIG. 2 shows said second variant installation referred to as the "Corridor"

In FIG. 2, the "Corridor" installation is made using an installation comprising:

- a zone marked on the ground, preferably comprising a mat 1 and a marking 2 for determining the position of the player's feet, the marking comprising at least two orthogonal lines XX', YY' which preferably intersect at the center of said zone, and preferably at the center of said mat;
- three posts $\mathbf{4}_1$, $\mathbf{4}_2$, $\mathbf{4}_3$ comprising two outer posts $\mathbf{4}_2$, $\mathbf{4}_3$ and a central post $\mathbf{4}_1$ in an alignment $X_1$, $X'_1$ parallel to one of said orthogonal lines XX' of said marking 2;
- the central post $\mathbf{4}_1$ being in alignment with the other orthogonal line YY' of said marking, two front panels $\mathbf{3}_1$ and $\mathbf{3}_2$ of different colors being placed respectively between each of the outer posts $\mathbf{4}_2$, $\mathbf{4}_3$ and the central post $\mathbf{4}_1$; and
- two rectangular side panels $\mathbf{9}_1$ and $\mathbf{9}_2$, preferably in the form of nets or wire netting disposed parallel and vertically on either side of said zone on the ground or said mat and close thereto, extending in a direction perpendicular to the direction in which said three posts are aligned so as to create the sensation of a corridor.

Said rectangular side panels are disposed on opposite sides of the mat, they are 5 m to 10 m long, with at least 3 m extending between the player and said posts and they are 2 m to 5 m high, the two side panels preferably being spaced apart from each other by 3 m to 5 m.

For the "Corridor" installation, the front panels are shorter than in the "Castle" installation and they are placed lower down.

- For a distance of 15 m between the front panels and the mat: the height of the posts is 6 m, the height of the top edge of the front panels is 5 m, and the length of each panel $\mathbf{3}_1$, $\mathbf{3}_2$ is 3 m.
- For a distance of 20 m between the front panels, the central posts and said mat: the height of the posts is 7 m, the height of the top edges of the front panels is 6 m, and the length of the front panels $\mathbf{3}_1$ and $\mathbf{3}_2$ is 3 m.

The relative positioning of the ball and the player's feet is monitored by said marking on the mat: for a mat having two orthogonal lines XX' and YY', the ball and the feet are placed respectively on opposite sides of a first line YY' that passes through the central post $\mathbf{4}_1$. For a right-handed player, the ball is on the right of said first line when looking at the central post. The player's feet are placed on either side of a second line XX' perpendicular to said first line YY' on which said ball is placed. Depending on which club is used, the feet should be placed in different positions, but the toes should always define a straight line extending parallel to said first line. In contrast, it is not essential for both feet to be placed symmetrically about said second line XX'.

It is the proximity of the side panels and the way they extend in front of the player which gives the sensation of being in a corridor.

In the absence of side panels and of marking on the ground, tests have shown that 98% of beginners align their feet systematically too far to the right for right-handed players and too far to the left for left-handed players.

A right-handed player should send a ball over the right-hand facing front panel and a left-handed player should cause the ball to go over the facing front panel of another color that is situated on the left.

Eight successful shots out of ten corresponds to a very good result.

This second variant of the installation is specifically designed for training or practicing for players having a handicap lying in the range 19 to 23.

Figure 3:
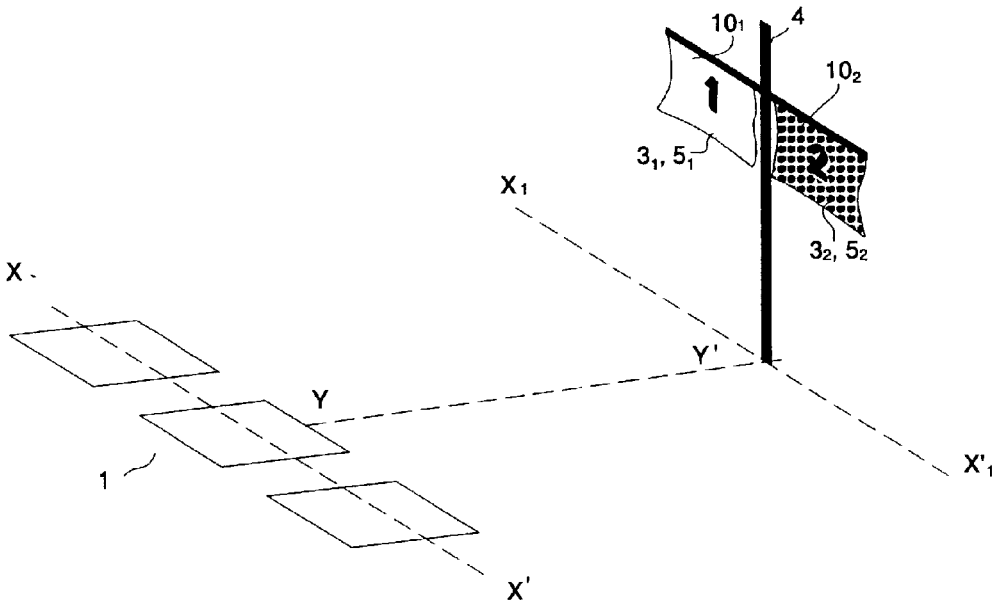
FIG. 3 shows said third variant installation referred to as the "Gallows"

To make the "Gallows" installation shown in FIG. 3, front panels $\mathbf{3}_1$ and $\mathbf{3}_2$ act as flags that are 3 m wide and 2 m high suspended from horizontal bars $\mathbf{10}_1$ and $\mathbf{10}_2$ forming a cross relative to the vertical post 4. The mat 1 has no marking for monitoring the position of the feet.

To ensure that practice with the "Gallows" constitutes progress after the "Corridor" where the notion of distance and height play an important role:

- the vertical post 4 should initially be placed at a distance of 20 m from the mats, i.e. from the straight line XX', with the post being 6 m high and the flag at a height of 5 m; and subsequently
- it should be placed at a distance of 25 m with the posts being 7 m high and the flags at a height of 6 m.

The vertical post 4 is surrounded by a protective net as described above. The horizontal metal bars $\mathbf{10}_1$ and $\mathbf{10}_2$ define the height of the flags and they are surrounded in a material that absorbs impacts by 98%, plus a thickness of foam.

Making tests with ten alternating drives, a positive result for eight out of ten drives corresponds to a very good level.

This third variant of the installation is specifically designed for training and practice by players having a handicap lying in the range 11 to 18, and it continues to constitute an excellent exercise for players having a handicap of 10.

Figure 4:
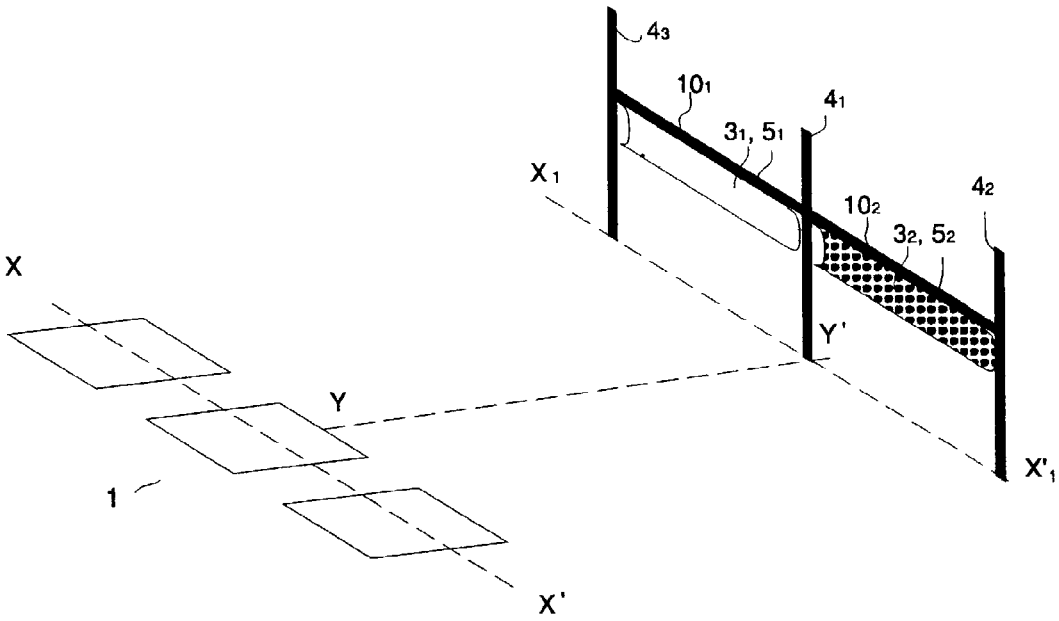
FIG. 4 shows said fourth variant installation referred to as the "Wide gates"

The "Wide gates" installation shown in FIG. 4 comprises two front panels that are 6 m long and 2 m high disposed between three vertical posts $\mathbf{4}_1$, $\mathbf{4}_2$, $\mathbf{4}_3$ supporting two horizontal bars $\mathbf{10}_1$, $\mathbf{10}_2$ having the front panels $\mathbf{3}_1$ and $\mathbf{3}_2$ of respective different colors $\mathbf{5}_1$ and $\mathbf{5}_2$ suspended therefrom. The front panels are placed at about 80 m from the player.

With the "Wide gates" height is of less importance, and this structure is intended above all for further training. For a distance between the front panel ($X_1X'_1$) and the mats (XX') of 80 m, the height of the panels is 6 m, the height of the flags is 5 m, and they are 6 m wide. There is no need to protect the posts or the front panels since a ball cannot get back to players from this distance.

By making players make series of drives successively in the installations of FIGS. 1 to 4, they have to make drives of ever increasing range and this corresponds to increasing difficulty.

This fourth installation is particularly suitable for a player whose level corresponds to a handicap of less than 10 in so far as the main problem for such players is generally one of stabilizing alignment.

A score of six successful tests out of ten corresponds to a good level.

These four installations can also be used for evaluating the level of a player by making a player perform ten shots in each installation and defining five levels as a function of the number of successful shots:

- level 1: 5 to 10 corresponding to a player having a handicap of 30;
- level 2: 10 to 15 corresponding to a player having a handicap of 20;
- level 3: 15 to 25 corresponding to a player having a handicap of 10;
- level 4: 25 to 35 corresponding to a player having a handicap of 5;
- level 5: 35 to 40 corresponding to a professional.

More particularly, for each installation specific levels are given: level 1 for 0 to 3 successful shots, level 2 for 4 to 6 successful shots, level 3 for 7 to 10 successful shots.

This method of evaluation in accordance with the invention makes it possible to define a player in terms of level and in terms of category. It also enables better evaluation of a player's swing, of notions that a player has already learnt, and of notions that a player still needs to learn in order to improve.

Figure 5:
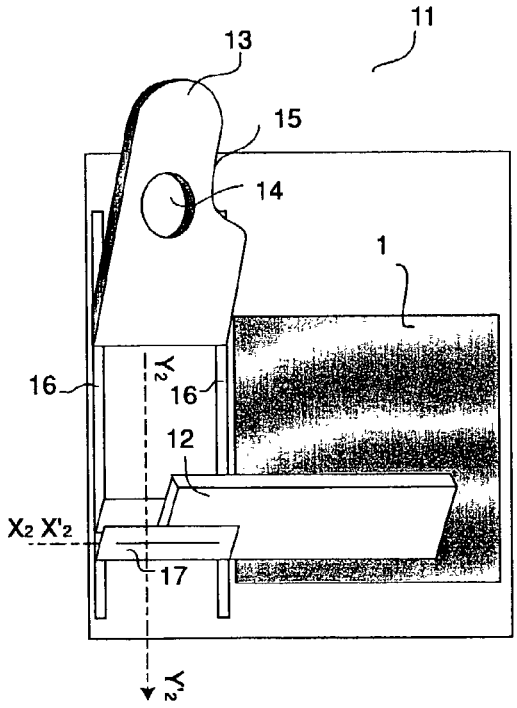
FIG. 5 shows a complementary training device.

FIG. 5 shows a complementary training device 11 for guiding the path followed by the club.

This device comprises:

- a first plate 12 which is rigid and low, preferably being less than 0.5 m high, situated in front of the player when the player is in position to drive a ball on the ground situated between the player and said first rigid plate, and at a distance of less than 10 cm from said first plate, said first rigid plate having a length of 1 m to 2.50 m; and
- a second plate that is very rigid and tall, preferably taller than 1.50 m, more preferably of height lying in the range 1.5 m to 2.5 m, situated in a position that is set back from the player by a distance of 50 cm to 1 m, and on the side of the player that corresponds to the side towards which the player raises a club before driving the ball.

The player must avoid touching either of the two plates when driving the ball.

In FIG. 5, the player thus stands on the mat 1 so that the ball to be driven is situated between the player and the first plate 12.

The ball is situated close to the first plate, thus ensuring that the player holds the club properly since otherwise the player will strike the plate.

The first plate 12 is 30 cm high and 1.80 m wide. It extends in the direction of the club after driving the ball over at least 1 m.

The second plate 13 is narrower, being about 1 m wide, but taller, i.e. at least 1.50 m and preferably about 1.80 m. It is placed on the right and set back relative to the player and behind the player, so that the player will strike said second plate 13 by raising the club incorrectly prior to driving the ball, particularly if the club follows a trajectory in a plane that is wrongly inclined.

The position of each of the plates relative to the player is adjustable since the plates are mounted on sliderails 16 such that:

- the second plate 13 can be moved so as to be set back to a greater or lesser extent in the direction $Y_2$, $Y'_2$ relative to the player;

the first plate can be moved forwards to a greater or lesser extent relative to the player likewise in the direction $Y_2$, $Y'_2$; and the first plate is mounted on a U-shaped support 17 which moves along the guide rails 16. In addition, the first plate 12 can slide relative to its support 16 in the orthogonal direction $X_2$, $X'_2$ perpendicular to the direction $Y_2$, $Y'_2$.

The second plate 13 is provided with a hole 14 in its top portion to ensure it does not present too much wind resistance. For the same reason, the top portion of the plate is notched 15 so as to reduce its width.

What is claimed is:

1. A method for playing and practicing golf, comprising the steps of:

positioning a player in a player zone marked on the ground, to monitor the player's position and golf mechanics, said player zone including at least one mat; and having said player attempt to play a ball over an obstacle, said obstacle having a height of at least about 2 m and being placed at a distance of between about 5 m and about 200 m from said player zone;

wherein said player uses an installation comprising:

means for defining said player zone and monitoring the position of said player within said player zone; and said obstacle;

said obstacle comprising at least one vertical front panel held by at least one post, said at least one vertical front panel defining at least two differently colored zones placed side by side in a transverse direction to said at least one post; wherein one of said vertical front panels has a vertical mid-axis, and a top edge between about 3 m and about 10 m above the ground;

said two differently colored zones are symmetrical about said vertical mid-axis of said at least one vertical front panel;

said at least one vertical front panel is situated at a distance of between about 5 m and about 25 m from said first player zone; and the ratio of said height of said obstacle to said distance is not less than about 1:3; and said player carries out the following steps in succession:

a) said player attempts to drive balls from said player zone to pass over any one of said differently colored zones of said installation; and b) said player attempts to drive balls from said player zone to pass in alternation over each of said differently colored zones in said installation.

2. A method according to claim 1, wherein said obstacle is placed at a distance not less than about 10 m from said player zone;

said means for defining said player zone comprises at least one mat; and said obstacle has a height of at least about 3 m.

3. A method according to claim 1, wherein said obstacle is placed at a distance of between about 5 m and about 100 m from said player zone and said obstacle has a height of between about 3 m and about 15 m.

4. A method according to claim 3, wherein the distance between said obstacle and said player zone is between about 10 m and about 80 m and the height of said obstacle is at least about 5 m.

5. A method according to claim 1, wherein said top edge of said at least one vertical front panel is between about 5 m and about 7 m above the ground.

6. A method according to claim 1, wherein said ratio is approximately 1:2.

7. A method according to claim 1, wherein said top edge of said at least one vertical front panel defines a crenellation comprising a notch in each of said differently colored zones.

8. A method according to claim 1, wherein said at least one front panel is between about 2 m and about 5 m in height.

9. A method according to claim 1, wherein said at least one vertical front panel is placed behind a protective net.

10. A method according to claim 1 wherein said obstacle is no more than about 5 m in height.

11. A method for playing and practicing golf, comprising the steps of:

positioning a player in a player zone marked on the ground, to monitor the player's position and golf mechanics, said player zone including at least one mat; and having said player attempt to play a ball over an obstacle, said obstacle having a height of at least about 2 m and being placed at a distance of between about 5 m and about 200 m from said player zone;

wherein said player uses a first installation comprising:

means for defining said player zone and monitoring the position of said player within said player zone; and said obstacle;

said obstacle comprising at least one vertical front panel held by at least one post, said at least one vertical front panel defining at least two differently colored zones placed side by side in a transverse direction to said at least one post; wherein said installation comprises a second installation including means for defining a second player zone, and a second obstacle;

said means for defining said second player zone includes a mat having markings comprising at least first and second intersecting orthogonal lines whose intersection lies at the center of said second player zone, said first orthogonal line being oriented generally in a direction from said second player zone towards said obstacle;

the relative positioning of the ball and said player being monitored by comparison of said relative positioning of the ball and said player to said markings on said mat; and said second obstacle including two front panels of different colors; and said installation further comprises three posts comprising two outer posts and a central post, said three posts being aligned parallel to said second orthogonal line;

said central post being aligned with said first orthogonal line;

said two front panels of different colors being disposed respectively between each of said outer posts and said central post;

two rectangular side panels, placed vertically on either side, of said player zone and close thereto, extending in a direction perpendicular to the direction in which said three posts are aligned so as to create a corridor; and said player attempts to drive balls in said second installation, with his feet positioned in a predetermined relationship relative to said markings on said mat and causing the balls to pass over one of said two front panels.

12. A method according to claim 11, wherein said central post is situated at a distance of between about 15 m and about 45 m from the center of said mat, and each of said front panels is between about 2 m and about 5 m in length, and has a top edge situated at a height of between about 3 m and about 10 m above the ground.

13. A method according to claim 12, wherein said top edge of said at least one vertical front panel is situated at a height of at least about 5 m above the ground.

14. A method according to claim 11, wherein right-handed players attempt to play the ball over the front panel to the right of said central post, and left-handed players attempt to play the ball over the front panel to the left of said central post.

15. A method for playing and practicing golf, comprising the steps of:

positioning a player in a player zone marked on the ground, to monitor the player's position and golf mechanics, said player zone including at least one mat; and having said player attempt to play a ball over an obstacle, said obstacle having a height of at least about 2 m and being placed at a distance of between about 5 m and about 200 m from said player zone;

wherein said player uses an installation comprising:

means for defining said player zone and monitoring the position of said player within said player zone; and said obstacle;

said obstacle comprising at least one vertical front panel held by at least one post, said at least one vertical front panel defining at least two differently colored zones placed side by side in a transverse direction to said at least one post;

a second installation comprising means for defining a second player zone, and a second obstacle;

a vertical post placed at a distance of between about 15 m and about 45 m from said player zone, which does not include any marking to monitor the position of said player's feet; and two vertical front panels of different colors placed on either side of said vertical post and wherein:

said player attempts to drive balls from said second player zone, to pass in alternation over each of said differently colored front panels of said second installation.

16. A method according to claim 15, wherein said vertical post is placed at a distance of between about 20 m and about 25 m from said player zone.

17. A method according to claim 15, wherein each of said vertical front panels is between about 2 m and about 5 m long and has a top edge situated at a height of between about 3 m and about 10 m above the ground.

18. A method according to claim 17, wherein said top edges of each of said vertical front panels is situated at a height of at least about 5 m above the ground.

19. A method according to claim 17, wherein said second obstacle further comprises at least one horizontal bar connected to said central post; and wherein each of said vertical front panels is suspended from said at least one horizontal bar.

20. A method for playing and practicing golf, comprising the steps of:

positioning a player in a player zone marked on the ground, to monitor the player's position and golf mechanics, said player zone including at least one mat; and having said player attempt to play a ball over an obstacle, said obstacle having a height of at least about 2 m and being placed at a distance of between about 5 m and about 200 m from said player zone;

wherein said player uses an installation comprising:

means for defining said player zone and monitoring the position of said player within said player zone; and said obstacle;

said obstacle comprising at least one vertical front panel held by at least one post, said at least one vertical front panel defining at least two differently colored zones placed side by side in a transverse direction to said at least one post;

said installation comprises a second installation including means for defining a second player zone, and a second obstacle;

said at least one post includes one central post and two outer posts positioned in a line;

two front panels of different colors are placed respectively between each said outer post and said central post;

said central post is placed at a distance of between about 50 m and about 200 m from said player zone;

each of said vertical front panels has a length of between about 5 m and about 10 m; and said top edge of each of said vertical front panels is situated at a height of between about 5 m and about 10 m above the ground; and wherein said method further comprises the step of:

said player attempting to drive balls from said second player zone, to pass in alternation over each of said front panels of different colors of said second installation.

21. A method according to claim 20, wherein said central post is placed at a distance of at least about 80 m from said player zone.

22. A method according to claim 20, wherein each of said vertical front panels is suspended from at least one horizontal bar which is connected to one of said outer posts and to said central post.

23. A method for playing and practicing golf, comprising the steps of:

positioning a player in a player zone marked on the ground, to monitor the player's position and golf mechanics, said player zone including at least one mat; and having said player attempt to play a ball over an obstacle, said obstacle having a height of at least about 2 m and being placed at a distance of between about 5 m and about 200 m from said player zone;

wherein said player uses an installation comprising:

means for defining said player zone and monitoring the position of said player within said player zone; and said obstacle;

said obstacle comprising at least one vertical front panel held by at least one post, said at least one vertical front panel defining at least two differently colored zones placed side by side in a transverse direction to said at least one post;

a low first plate situated in front of the position of said player when said player is positioned to drive a ball which is situated on the ground between said player and said low first plate, at a distance from said low first plate that is greater than half the width of the face of a club used by said player; and a tall second plate set back from the position of said player and on the side of the player that corresponds to the side towards which the player raises said club prior to driving said ball, said tall second plate being situated immediately behind the high starting position of said club before said player begins to drive said ball;

such that the player must avoid touching either of said first and second plates when driving said ball and preparing to drive said ball.

24. A method according to claim 23, wherein said first low plate is less than about 0.5 m high.

25. A method according to claim 23, wherein said tall second plate is at least about 1.5 m high.

26. A method according to claim 25, wherein said tall second plate is no more than about 2.5 m high.

27. A method for playing and practicing golf, comprising the steps of:

successively positioning a player in first, second, third and fourth player zones marked on the ground, to monitor said player's position and golf mechanics, said second player zone including at least one mat having first and second orthogonal lines thereon;

monitoring the position of said player within said player zones, including the position of said player's feet in at least one of said player zones; and having said player attempt to play a ball over at least first, second, third and fourth obstacles in succession, each of said obstacles having a height of at least about 2 m and being placed at a distance of between about 5 m and about 200 m from a respective one of said player zones;

wherein said player uses an installation comprising:

means for defining said player zones, said means for defining including said mat;

said first obstacle, said first obstacle including a first vertical front panel held by a first post, said first vertical front panel defining a first zone of a first color and a second zone of a second color different from said first color, said first and second zones being placed side by side in a direction transverse to said first post;

said first vertical front panel having a vertical mid-axis, and a top edge between about 3 m and about 10 m above the ground;

said first and second zones being symmetrical about said vertical mid-axis of said first vertical front panel;

said first vertical front panel being situated at a first distance of between about 5 m and about 25 m from said first player zone; and the ratio of said height of said first obstacle to said first distance is not less than about 1:3;

said second obstacle includes at least a second vertical front panel disposed between second and third posts;

said second post being aligned with said first orthogonal line; and said third post being aligned with said second post in a direction that is parallel to said second orthogonal line;

first and second rectangular side panels, disposed vertically on either side of said second player zone and close thereto, extending in a direction parallel to said first orthogonal line;

said third obstacle including at least second and third vertical front panels held by at least a fourth post, said fourth post being placed at a distance of between about 15 m and about 45 m from said third player zone, which does not include any marking to monitor the position of said player's feet;

a third vertical front panel having a third color, and being placed on a first side of said fourth post;

a fourth vertical front panel having a fourth color different from said third color, and being placed on the side of said fourth post opposite to said first side thereof and said fourth obstacle including at least fifth and sixth vertical front panels held by at least fifth, sixth and seventh posts;

said fifth, sixth and seventh posts forming a line, with said sixth post being disposed between said fifth and seventh posts;

said fifth vertical front panel being disposed between said fifth and sixth posts, and being of a fifth color;

said sixth vertical front panel being disposed between said sixth and seventh posts, and being of a sixth color, different from said fifth color;

said sixth post being placed at a distance of between about 50 m and about 200 m from said fourth player zone;

each of said fifth and sixth vertical front panels having a length of between about 5 m and about 10 m; and said top edge of each of said fifth and sixth vertical front panels being situated at a height of between about 5 m and about 10 m above the ground.

28. A method according to claim 27, wherein a series of ten drives is successively attempted over each of said first, second, third and fourth obstacles, from said first, second, third and fourth player zones, respectively.

29. A method according to claim 28, wherein said player carries out the following steps in succession:

a) the player drives balls from said first player zone causing each ball to pass over said first obstacle;

b) the player drives balls from said first player zone causing the balls to pass in alternation over each of said zones of said first obstacle;

c) the player drives balls over said second obstacle, with his feet positioned in a predetermined position relative to said first and second orthogonal lines, and causing the balls to pass over said second vertical front panel;

d) the player drives balls from said third player zone, causing the balls to pass in alternation over each of said second and third vertical front panels of said third obstacle; and e) the player drives balls from said fourth player zone, causing the balls to pass in alternation over each of said fifth and sixth vertical front panels of said fourth obstacle.

30. A method according to claim 27, wherein each of said obstacles is no more than about 5 m in height.

31. A method according to any one of claims 11, and 27, wherein at least one of said rectangular side panels includes netting.

32. A method of evaluating the level of a golf player, wherein said player performs a series of shots in a method according to any one of claims 1, 11, 15, 20 and 27, and a level is given to the player as a function of the number of successful shots.

33. A method according to any one of claims 1, 11, 15, 20 and 27 wherein at least one vertical front panel is movable vertically relative to the ground along said post or posts.

34. A method according to any one of any one of claims 1, 11, 15, 20 and 27 wherein at least one of said post or posts is surrounded by a protective net.

35. A method according to any one of claims 1, 11, 15, 20 and 27 wherein at least one of said vertical front panels is placed behind a protective net.

36. A method according to any one of claims 1, 11, 15, 20 and 27 further comprising the step of:

varying at least one of said distance and said height of said obstacle depending upon the skill level of said player.

37. A method for learning and training to play and practice golf comprising the steps of:

positioning a player in a player zone marked on the ground, to monitor the player's position and golf mechanics, said player zone including at least one mat;

having said player attempt to play a ball over an obstacle, said obstacle having a height of at least about 2 m and being placed at a distance of between about 5 m and about 200 m from said player zone; and wherein said player uses an installation comprising:

means for defining said player zone on the ground and monitoring the position of said player within said player zone; and said obstacle over which said player is to play said ball, said means for defining said player zone including a mat having markings comprising at least first and second intersecting orthogonal lines whose intersection lies at the center of said player zone, the relative positioning of said ball and said player being monitored by comparing the position of said player and the swing of said player to said markings on said mat; and said obstacle including:

a central post, first and second outer posts disposed on opposite sides of said central post, a first front panel disposed between said first outer post and said central post and having a first color, and a second front panel disposed between said second outer post and said central post, and having a second color;

said central post and said first and second outer posts being aligned parallel to one of said first and second intersecting orthogonal lines;

said central post being aligned with the other of said first and second intersecting orthogonal lines; and the said installation further comprising two rectangular side panels, placed vertically on either side of said player zone and close thereto, extending in a direction perpendicular to the direction in which said two outer posts are aligned so as to create a corridor therebetween.

38. A method according to claim 37, wherein said central post is situated at a distance of between about 15 m and about 45 m from the center of said mat, and each of said front panels is between about 2 m and about 5 m in length, and has a top edge situated at a height of between about 3 m and about 10 m above the ground.

39. A method according to claim 38, wherein top edge of said at least one vertical front panel is situated at a height of at least about 5 m above the ground.

40. A method according to claim 37, wherein right-handed players attempt to play the ball over the front panel to the right of said central post, and left-handed players attempt to play the ball over the front panel to the left of said central post.

41. A method for playing and practicing golf, comprising the steps of:

positioning a player in a player zone marked on the ground, to monitor the player's position and golf mechanics, said player zone including at least one mat; and having said player attempt to play a ball over an obstacle, said obstacle having a height of at least about 2 m and being placed at a distance of between about 5 m and about 200 m from said player zone;

wherein said player uses an installation comprising:

means for defining said player zone and monitoring the position of said player within said player zone; and said obstacle;

said obstacle comprising at least one vertical front panel held by at least one post, said at least one vertical front panel defining at least two differently colored zones placed side by side in a transverse direction to said at least one post;

wherein first, second, third and fourth installations respectively are used in succession, and wherein a) said first installation comprises means for defining a first player zone, and a first obstacle, said first obstacle including a first vertical front panel defining said two differently colored zones side by side;

said one front panel has a vertical mid-axis, and a top edge between about 3 m and about 10 m above the ground;

said differently colored zones side by side are disposed symmetrically about said vertical mid-axis of said one vertical front panel;

said first vertical front panel being situated at a distance of between about 5 m and about 25 m from said player zone;

the ratio of said height of said obstacle to said distance is not less than about 1:3; and b) said second installation including means for defining a second player zone, and a second obstacle, said means for defining a second player zone including a mat having markings thereon having at least first and second intersecting orthogonal lines whose intersection lies at the center of said second player zone, the relative positioning position of the ball and said player being monitored by said markings on said mat;

said means for defining said second obstacle comprising second and third front panels of different colors;

said at least one post comprises three posts including first and second outer posts and a first central post, said central post and said first and second outer posts being aligned parallel to one of said first and second intersecting orthogonal lines;

said first central post being aligned with the other of said first and second intersecting orthogonal lines;

said second front panel being disposed between said first outer post and said central post;

said third front panel being disposed between said second outer post and said central post; and said second installation further including two rectangular side panels, placed vertically on either side of said second player zone and close thereto, extending in a direction perpendicular to the direction in which said central post and said first and second outer posts are aligned so as to create a corridor therebetween;

c) said third installation including means for defining a third player zone, and a third obstacle;

said third obstacle comprising fourth and fifth vertical front panels of different colors placed on either side of a vertical post;

said vertical post being placed at a distance of between about 15 m and about 45 m from said third player zone;

d) said fourth installation comprising means for defining a fourth player zone, and a fourth obstacle;

said fourth obstacle comprising a second central post and third and fourth outer posts positioned in a line;

a sixth vertical front panel placed between said third outer post and said second central post;

a seventh front panels of a color different from that of said sixth vertical front panel, and being placed between said fourth outer post and said second central post;

said second central post being placed at a distance of between about 50 m and about 200 m from said fourth player zone;

each of said sixth and seventh vertical front panels having a length of between about 5 m and about 10 m; and each of said sixth and seventh vertical front panels being situated at a height of between about 5 m and about 10 m above the ground.

* * * * *